US006802696B1

(12) United States Patent
Verhaegen

(10) Patent No.: US 6,802,696 B1
(45) Date of Patent: Oct. 12, 2004

(54) MULTISTAGE COMPRESSOR UNIT AND METHOD FOR REGULATING SUCH MULTISTAGE COMPRESSOR UNIT

(75) Inventor: Ken Gustaaf Helena Verhaegen, Puurs (BE)

(73) Assignee: Atlas Copco Airpower, Naamloze Vennootschap, Wilrijk (BE)

( * ) Notice: Subject to any disclaimer, the term of this patent is extended or adjusted under 35 U.S.C. 154(b) by 53 days.

(21) Appl. No.: 10/110,770

(22) PCT Filed: Oct. 24, 2000

(86) PCT No.: PCT/BE00/00117

§ 371 (c)(1),
(2), (4) Date: Aug. 13, 2002

(87) PCT Pub. No.: WO01/31202

PCT Pub. Date: May 3, 2001

(30) Foreign Application Priority Data

Oct. 26, 1999 (BE) ..... 09900699

(51) Int. Cl.[7] ..... F04C 23/02
(52) U.S. Cl. ..... 417/2
(58) Field of Search ..... 417/2, 243, 426

(56) References Cited

U.S. PATENT DOCUMENTS 3,584,977 A * 6/1971 Coleman et al. ..... 417/2
4,770,609 A * 9/1988 Uchida et al. ..... 417/2
6,056,510 A * 5/2000 Miura et al. ..... 417/2

FOREIGN PATENT DOCUMENTS

JP 7-158576 * 6/1995
JP 10-82391 * 3/1998

* cited by examiner

*Primary Examiner*—Michael Koczo
(74) *Attorney, Agent, or Firm*—Bacon & Thomas, PLLC

(57) ABSTRACT

The invention relates to a multistage compressor unit which comprises at least two different compressor elements (1 and 2) driven by means of separate electric motors (3, 4) with an adjustable speed, whereby the outlet (8) of a compressor element (1) of one stage connected to the inlet (10) of a successive compressor element (2) of a successive stage, characterized in that the electric motors (2, 4) are identical and therefore have approximately one and the same nominal capacity, whereas between each motor (3, 4) and the compressor element (1, 2) driven thereby, a gear transmission (13, 14) is provided.

16 Claims, 1 Drawing Sheet

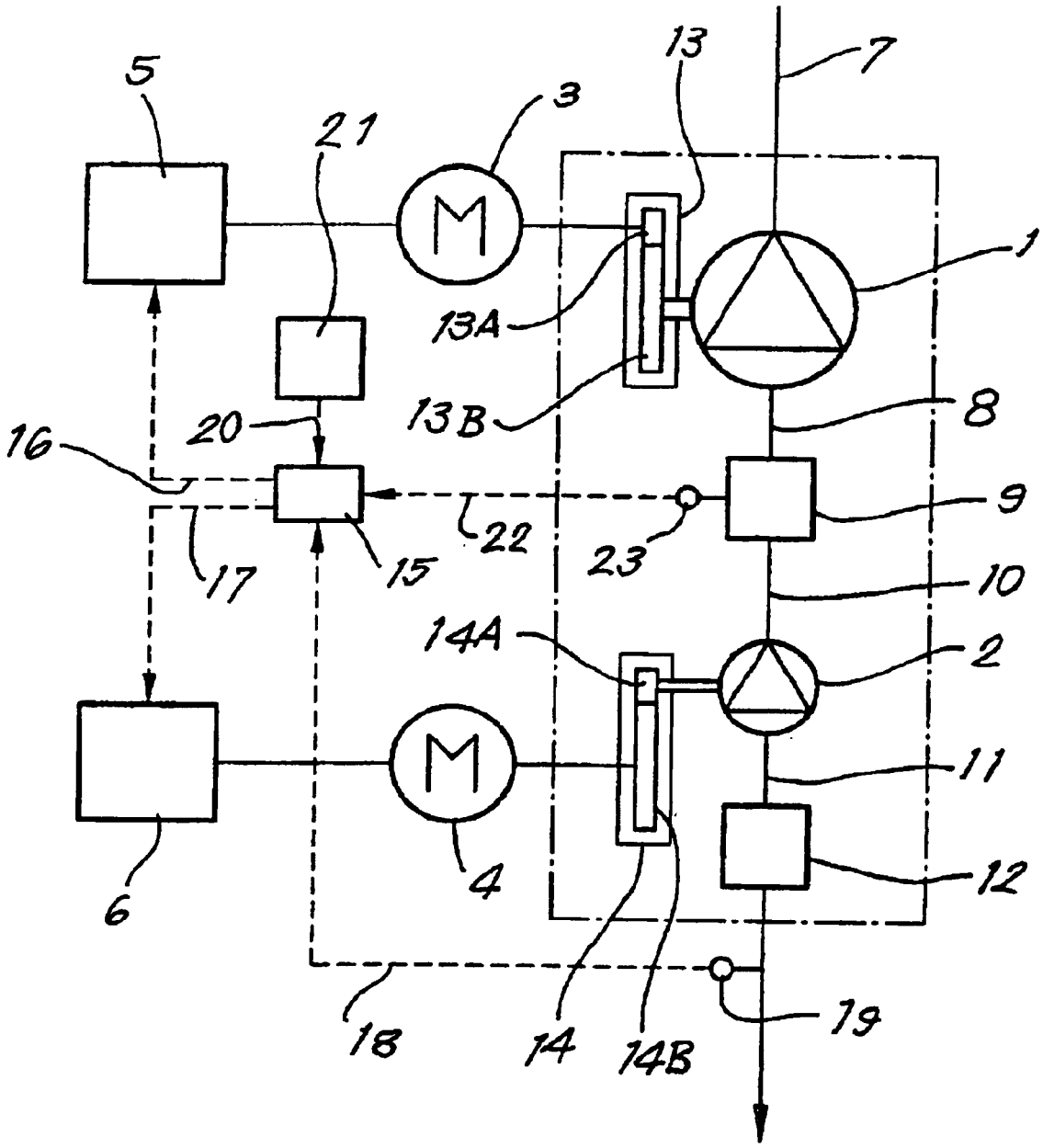
5
21
3
13
7
1
13A
13B
8
16
20
9
22
23
17
15
10
14A
2
11
6
4
12
18
14
14B
19

MULTISTAGE COMPRESSOR UNIT AND METHOD FOR REGULATING SUCH MULTISTAGE COMPRESSOR UNIT

BACKGROUND OF THE INVENTION

Field of the Invention

This invention relates to a multistage compressor unit comprising at least two different compressor elements driven by means of separate electric motors with an adjustable speed, whereby the outlet of a compressor element of one stage is connected to the inlet of a successive compressor element of a successive stage.

Contrary to the volume flow rate and the pressure ratio, the mass flow rate of such multistage compressor unit is constant in each of the stages.

Due to the different volume flow rate and the different pressure ratio, the speed of each compressor element is different and is determined by the output pressure and the final volume flow rate.

In some known two-stage compressor units with variable speed, the means for driving the compressor elements of the two stages comprise a single large electric standard motor which is driven by means of a large invertor or frequency regulator.

This motor drives the compressor elements by the intermediary of one large gearwheel.

The compressor elements have a built-in pressure ratio and belong to a series of elements which were designed such that they can be applied in one stage as well as in several stages, whereby then a minimum number of compressor elements reaches an entire range of air capacities.

Furthermore, the inertion of a larger motor with a large gearwheel is relatively high, as a result of which the response of the compressor unit is relatively slow, unless the motor is over-dimensioned.

As a result of the fixed speed ratio between the compressor elements of the different stages, the efficiency of the compressor unit is restricted over its complete working range. The present compressor units have only one optimum efficiency for one well-defined output pressure and volume flow rate.

From JP 07158576 A in the name of Kobe Steel Ltd, a two-stage compressor unit is known, the two compressor elements of which are driven by separate motors, whereby the speed of the motors is adjusted by means of an invertor. In an embodiment, the two invertors are controlled by means of a same control device in function of the pressure between the two stages. In another form of embodiment, the invertors are controlled by separate control devices, in function of the pressure between the stages, the pressure at the exit of the high-pressure stage, respectively.

The compressor element of the low-pressure stage is larger than the compressor element of the high-pressure stage, and the nominal rotational speeds of the compressor elements are different. Therefore, the compressor element of the high-pressure stage is driven without transmission by means of a smaller motor than the compressor element of the low-pressure stage which is driven by means of a gear transmission and by a larger motor. This construction is relatively complicated and expensive.

JP 02140477 A also describes a two-stage compressor unit, in which two similar compressor elements are installed in one housing and are driven directly by motors, the speed of which is regulated separately by an invertor. The efficiency of such compressor unit, however, is not optimum.

The invention aims at a multistage compressor unit which does not show the aforementioned disadvantages, is relatively economic and can work in a simple manner with an optimum efficiency.

SUMMARY OF THE INVENTION

According to the invention, this aim is achieved in that in the compressor unit, as defined in the first paragraph, the electric motors are identical and therefore have an approximately identical nominal capacity, whereas between each motor and the compressor element driven thereby, a gear transmission is provided.

In spite of the fact that the compressor elements are different in order be able to operate in an optimum manner, the motors, however, are identical. Therefore, motors of the same type and with the same nominal capacity which already are on the market can be used, which allows to reduce the price.

If the compressor unit comprises two stages and, therefore, two compressor elements, hereby the one gear transmission, in particular the one at the low-pressure stage, may cause a speed reduction in respect to the rotational speed of the corresponding motor, whereas the other gear transmission, namely, the one at the high-pressure stage, causes a speed increase in respect of the rotational speed of the corresponding motor.

By an efficient selection of the motors, both gear transmissions, as well as the motors, can be identical, whereby both gear transmissions comprise a large and a small gearwheel which are exchanged in the one gear transmission in respect to the other gear transmission.

These motors preferably are high-speed motors.

Preferably, the electric motors are coupled to their own frequency regulator, such that the frequency and, therefore, the speed can be regulated separately per motor.

The invention also relates to a method for regulating a multistage compressor unit according to any of the preceding forms of embodiment, which therefore comprises a identical electric motor per compressor element which is fed by means of a pertaining frequency regulator, such that the frequency and, therefore, the speed can be regulated separately per motor, wherein the speed ratio between the motors of the different stages is adjusted continuously in order to obtain an optimum overall efficiency.

Energy saving is achieved by adjusting the speed ratio of the stages and, therefore, the pressure ratio between the different stages in such a manner that, apart from a desired output pressure, an optimum overall efficiency of the compressor unit is obtained.

The optimum efficiency of the compressor unit is obtained by optimizing the speed of each stage and, therefore, the pressure ratio over each stage.

During this adjustment of the speed ratio, the output pressure is measured and, in function thereof, the speed of one of the motors is adapted immediately. This motor, mostly called "master", either may be the motor of the low-pressure stage or the motor of the high-pressure stage.

The optimum speed and, therefore, pressure ratio on each stage is known and present in a databank or can be calculated by means of an algorithm, for example, a fuzzy control, in real time.

After altering the speed of this motor, the optimum speed ratio is determined by means of a databank or an algorithm in function of the speed of said motor and the measured output pressure in order to thereby adapt the speed of the other motors.

Preferably, the speed ratio between the motors is determined for each condition of the compressor unit in function of the measured output pressure and is taken from a databank or is calculated by means of a real-time algorithm.

With the intention of better showing the characteristics of the invention, hereafter, as an example without any limitative character, a preferred form of embodiment of a multistage compressor unit and of a method for regulating such multistage compressor unit according to the invention is described, with reference to the accompanying drawing which schematically represents such compressor unit.

BRIEF DESCRIPTION OF THE DRAWING

In the FIGURE a two-stage compressor unit is represented which substantially comprises a larger compressor element 1 for the low-pressure stage and a smaller compressor element 2 for the high-pressure stage and two electric motors 3 and 4 which are fed by frequency regulators 5, 6 respectively.

DETAILED DESCRIPTION OF PREFERRED EMBODIMENTS

Both compressor elements 1 and 2 are volumetric compressor elements, namely, screw-type compressor elements.

In a variant, however, they may also be other volumetric compressor elements, such as helical compressor elements, or may even be dynamic compressor elements.

The compressor element 1 comprises an inlet 7 and a low-pressure outlet 8 which, by means of a cooler 9, is connected to the inlet 10 of the compressor element 2 which is provided with a high-pressure outlet 11.

In the represented example, an aftercooler 12 is installed in this outlet.

Both motors 3 and 4 are high-speed motors and identical to each other, in other words, they have the same nominal capacity.

Thus, they normally also have the same rotor, the same stator and the same bearings. In fact, they may be completely identical and, therefore, of the same commercial type.

The compressor element 1 is coupled to the motor 3 by means of a first small gear transmission 13, whereas the compressor element 2 is coupled to the motor 4 by means of a second small gear transmission 14.

The gear transmissions 13 consists of two gearwheels mounted in a gearwheel housing, namely, a small gearwheel 13A on the shaft of the motor 3 which engages into a large gearwheel 13B which is fixed to the driving shaft of the compressor element 1, and therefore causes a speed reduction.

The gear transmission 14 is identical to the gear transmission 13 and thus also comprises a small gearwheel 14A which engages into a large gearwheel 14B, however, the gearwheels 14A and 14B are exchanged, in other words, the small gearwheel 14A now is fixed to the driving shaft of the compressor element 2, whereas the large gearwheel 14B rotates along with the shaft of the motor 4.

The gear transmission 14 thus causes a speed increase.

The nominal capacity of the motors 3 and 4 thus is practically the same and is chosen equal to the maximum capacity which is necessary to drive the compressor element requiring the largest capacity.

In that in this installation, the smallest compressor element 2 rotates faster than the largest compressor element 3, the designed rotational speed of the motors 3 and 4 is chosen between the maximum rotational speeds of the two compressor elements 1 and 2, and preferably in the middle between these rotational speeds.

The precise maximum rotational speeds of these compressor elements 1 and 2 are obtained by means of the gear transmissions 13 and 14.

Not only the motors 3 and 4 are identical, but also the frequency regulators 5 and 6 may be identical and therefore may have the same capacity.

Further, the compressor unit comprises a control device 15, for example a PLC control, which, on one hand, is connected with its outputs to the two frequency regulators 5 and 6, by means of electrical conduits 16 and 17, and, on the other hand, is connected with a first input, by means of a circuit 18, to a pressure meter 19 at the outlet 11 of the compressor element 2 and is connected with a second input, by means of a conduit 20, to means 21 for setting the desired output pressure.

In a variant, a third input of the control device 15 is connected to the connection between the compressor elements 1 and 2 by means of a conduit 22 with a pressure sensor 23, for example such as represented with the cooler 9.

By driving each compressor element 1 and 2 by a pertaining motor 3 or 4, the rotational speed of each of these compressor elements 1 and 2 can be regulated separately.

The regulation may take place by the control device 15 effecting on the frequency regulators 5 and 6 in function of the pressure measured by the pressure meter 19 in the outlet 11 and of the desired or requested output pressure adjusted by the means 21, for example by means of an algorithm, for example a fuzzy control, such that always an optimum efficiency of the compressor unit can be achieved by means of a continuous, optimum adjustment of the speed ratio of the motors 3 and 4 of the stages.

In this regulation, use can also be made of the intermediate pressure measured by the pressure meter sensor 23, whereby this intermediate pressure is used in combination with the output pressure measured by the pressure meter 19.

The frequency regulators 5 and 6 have the same capacity which is only half of the capacity which is necessary when there is only one motor. The gearwheel housings 13 and 14 are relatively small, and also the motors 3 and 4 may be relatively small, such that the compressor unit certainly is not larger and heavier than with a single large motor with a large and expensive gear housing.

By using high-speed motors which are smaller and lighter than standard motors of the same capacity, the compressor unit can be built more compact and light, as a result of which less material is required and the unit becomes less expensive, whereas less floor area is required for it and the transport costs will be reduced. An additional advantage of the use of more compact high-speed motors is the lower inertion, as a consequence of which the response is faster.

As the compressor unit comprises identical motors 3 and 4, identical frequency regulators 5 and 6 and identical gear transmissions 13 and 14, the design thereof is relatively simple and economical. Also, the costs for storing are reduced.

Less types of motors are required, as a result of which a smaller stock is necessary and the motors can be produced in larger series and, consequently, less expensive.

The number of stages is not limited to two. For each stage or each compressor elements, a separate motor with adjustable speed is present.

The compressor unit does not necessarily have to comprise a cooler 9 between the compressor, elements 1 and 2, and the aftercooler 12 also is not absolutely necessary.

The invention is in no way limited to the form of embodiment described heretofore and represented in the accompanying drawing, on the contrary may such multistage compressor unit and method for the regulation thereof be realized in different variants without leaving the scope of the appended claims.

What is claimed is:

1. Multistage compressor unit comprising at least two different compressor elements and at least two separate electric motors with an adjustable speed, said compressor elements being driven by said electric motors;

wherein the outlet of a compressor element (1) of one lower stage is connected to the inlet of a successive compressor element of a successive higher stage; and wherein the electric motors have approximately one and the same nominal capacity, and a gear transmission is provided between each motor and a respective one of the compressor elements.

2. Multistage compressor unit according to claim 1, wherein a first one of the gear transmissions at a low pressure stage causes a speed reduction with respect to the rotational speed of the corresponding motor, the second one of the gear transmissions at a high-pressure stage causes a speed increase with respect to the rotational speed of the corresponding motor.

3. Multistage compressor unit according to claim 2, wherein the first and second gear transmissions include identical pairs of gearwheels, each pair comprising a small and a large gearwheel, which are exchanged in the one gear transmission with respect to the other gear transmission, and wherein the small gearwheels are identical and the large gearwheels are identical.

4. Multistage compressor unit according to claim 2, wherein the rotational speed of the motors is selected on the basis of the median of the rotational speeds of the two compressor elements.

5. Multistage compressor unit according to claim 1, wherein the electric motors are coupled to their own frequency regulator, such that the frequency and the speed can be regulated separately per motor.

6. Multistage compressor unit according to claim 5, further comprising a control device coupled to a pressure meter for measuring the pressure at the outlet of the last stage, and to means for setting the desired output pressure, and which, as a function of the value measured by this pressure meter and of the desired output pressure set by means of the means for setting the desired output pressure, controls the frequency regulators.

7. Multistage compressor unit according to claim 6, wherein the control device (15) is coupled to a pressure sensor for measuring the intermediate pressure in between the compressor elements.

8. Multistage compressor unit according to claim 1, wherein a cooler is installed between the compressor elements.

9. Multistage compressor unit according to claim 1, wherein an aftercooler is installed in the outlet of the last compressor element.

10. Method for regulating a multistage and multi-element compressor unit having an electric motor per compressor element fed by a pertaining frequency regulator, said motors having the same nominal capacity, the method comprising the steps of: regulating the frequency and the speed separately per motor; and adjusting the speed ratio between the motors of the different stages.

11. Method according to claim 10, wherein the speed ratio between the motors is determined for each condition of the compressor unit as a function of the measured output pressure.

12. Method according to claim 11, wherein the speed ratio between the motors is determined as a function of the intermediate pressure measured in between two stages.

13. Method according to claim 10, wherein the speed of one of the motors is immediately adapted with a pressure difference between the measured output pressure and a desired output pressure, wherein the speed ratio is adjusted in order to alter the speed of the other motors as a function of the speed of one of the motors and the measured output pressure.

14. Method according to claim 11, wherein the measured output pressure is taken from a databank.

15. Method according to claim 11, wherein the measured output pressure is calculated in realtime by an algorithm.

16. Method according to claim 11, wherein the measured output pressure is calculated in realtime by a fuzzy logic control.

* * * * *